US006425577B1

(12) United States Patent
Giovanni

(10) Patent No.: US 6,425,577 B1
(45) Date of Patent: Jul. 30, 2002

(54) FASTENING UNIT FOR BLOCKING THE ITEMS TO BE PROCESSED ON THE WORKING PLANE OF A WOODWORKING TOOLING MACHINE, AND A TOOLING MACHINE EQUIPPED WITH SAID UNIT

(75) Inventor: Sella Giovanni, Thiene (IT)

(73) Assignee: Essetre di Sella Giovanni, Thiene (IT)

( * ) Notice: Subject to any disclaimer, the term of this patent is extended or adjusted under 35 U.S.C. 154(b) by 55 days.

(21) Appl. No.: 09/633,811

(22) Filed: Aug. 7, 2000

(30) Foreign Application Priority Data

Aug. 9, 1999 (IT) ..... MI99A1797

(51) Int. Cl.[7] ..... B66F 15/00
(52) U.S. Cl. ..... 269/25
(58) Field of Search ..... 269/21, 25, 71, 269/20, 152, 97, 95, 88, 266; 279/3; 294/64.1; 51/235

(56) References Cited

U.S. PATENT DOCUMENTS 5,457,868 A * 10/1995 Blaimschein ..... 269/21
5,582,397 A * 12/1996 Lanvin ..... 269/25
5,842,690 A * 12/1998 Lee et al. ..... 269/21
6,206,352 B1 * 3/2001 Ishitani et al. ..... 269/21

* cited by examiner

*Primary Examiner*—Robert C. Watson
(74) *Attorney, Agent, or Firm*—Young & Thompson

(57) ABSTRACT

A fastening unit for fastening the items to be processed on the working plane of a tooling machine having a mobile support movable along a guide equipped with devices for fastening the items. The fastening unit has at least one device for fastening an item to be processed. The device for fastening includes a pressing element which is mobile between a raised position allowing the introduction of the item and a lowered position in which it fastens the item against a support.

14 Claims, 1 Drawing Sheet

Figure 1:
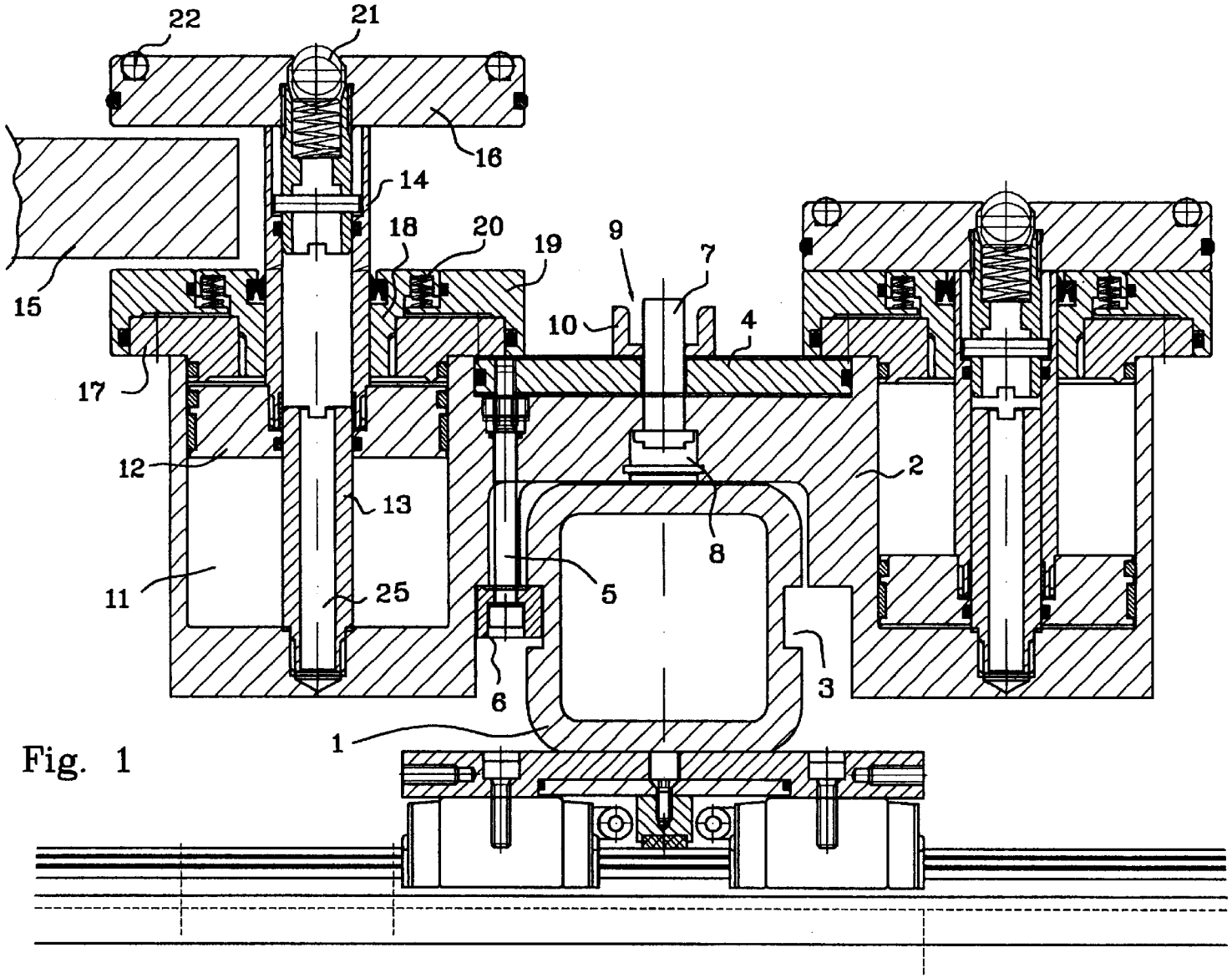

FASTENING UNIT FOR BLOCKING THE ITEMS TO BE PROCESSED ON THE WORKING PLANE OF A WOODWORKING TOOLING MACHINE, AND A TOOLING MACHINE EQUIPPED WITH SAID UNIT

BACKGROUND OF THE INVENTION

This invention refers to a fastening unit for blocking the items to be processed on the working plane of a tooling machine, designed in particular for woodworking purposes. This is a unit mounted on supports designed to be positioned on the working plane of a tooling machine, comprising suction devices capable of ensuring the blocking of items such as a panel or the like placed on the working plane, as well as pressing elements capable of clamping the item at its edges, so as to allow, thanks to the fact that these fastening units can be shifted and positioned on the plane at will, even items of complex shapes to be blocked and processed quickly and easily.

The fastening unit according to the invention presents the support holding the item in a manner which is mobile in height, so as to enable the fastening unit to be inserted around the item and to adapt the level of the holding plane to any deformations an/or curvatures of the item itself.

The fastening unit according to the invention is particularly suitable for application on woodworking machines such as illustrated by the U.S. Pat. No. 1,270,691 by the same Applicant.

This patent describes a machine for the processing of panels in which the working plane comprises a pair of guides arranged along a first axis, on which a multiple number of cross beams are allowed to slide while carrying each one or more mobile fastening devices mounted on the cross beams along an axis orthogonal to the previous axis.

Each support is equipped with suction devices capable of ensuring the blocking of a panel placed on the working plane, and each support also offers a hollow capable of being engaged by an element such as a pin or the like mounted on the machine's operating head, so as to allow using the same tooling head to shift these supports along the working plane until moving them to the required position.

As mentioned above, in these known machines the fastening of the items occurs by depression, by placing the item on suction elements connected to aspirating devices capable of creating a vacuum inside the suction cup and of blocking the panel during the processing step.

While this system works well on the panels, it nevertheless exhibits a few shortcomings when it comes to the processing of items of a limited width and complex shape, which must be processed on all sides and are difficult to position and block on the working plane. In these cases, at the present state of the art some machines are used which comprise a series of suction cups on which the item is placed, and a series of separate pressing elements mounted on a support provided above the working plane, which must be mounted and removed manually. The pressing element s are lowered to firmly clamp the item the suction cup would be unable to hold during the processing phase. This involves the need to have two series of devices, suctions cups and pressing elements respectively, where the first are arranged on the working plane and the second above the same, with the resulting construction complications and costs.

In order to avoid these shortcomings, this invention offers a fastening unit for the items to be processed, comprising a support freely moving along a cross beam mounted on the working plane and equipped with a pair of blocking devices, each including suction cups capable of blocking the item placed on the plane, and pressing elements capable of clamping the piece at an edge, while still resting on the working plane.

This invention will now be described in detail, for exemplifying and non limiting purposes, with reference to the single attached FIGURE which offers a cross-sectional view of the fastening unit according to the invention.

DETAILED DESCRIPTION OF THE PREFERRED EMBODIMENTS

With reference to the attached FIGURE, the number 1 indicates a cross beam which is mobile on the working plane along a first axis, for instance the axis X, which mounts a sliding support 2, capable of moving in a direction orthogonal to that of the previous axis Y, coinciding for instance with the axis of the cross beam itself.

The side walls of the latter each hold a pair of grooves, marked by the number 3.

The support 2 mounts a vertically mobile plate 4 holding one or more pairs of bolts 5 whose heads, indicated by 6, fit into the grooves 3.

The thickness of the heads is less than the depth of the grooves 3, so that the plate 4 is capable of effecting small shifting movements in an upward and downward direction, equal to the difference between the depth of the grooves 3 and the thickness of the heads 6. The plate 4 is crossed by a rod 7 which slides inside a small diameter chamber 8 provided in the support 2.

The extremity of the rod 7 projects into the interior of a seat 9 which is bounded by a cylindrical wall 10 firmly attached to the plate 4.

Some devices of a known type not shown in the FIGURE convey compressed air to the chamber 8 and the zone separating the support 2 and the plate 4.

In order to shift the support it will suffice to insert a pin into the seat 9, so as to push the piston downward and discharge the compressed air across the chamber 8, thus allowing the plate 4 to be lowered and unblock the support which can be made to slide along the cross beam.

The pin inserted into the seat 9 may for example be a pin mounted on the machine's operating head, which can thus be used for properly positioning the fastening units on the working plane, while sliding them along two orthogonal directions.

Each support 2 is shaped so as to laterally provide a pair of cylinders 11 each holding a sliding piston indicated by the number 12, which slides along a central rod 13 inside the chamber 11.

Moreover, the piston 12 holds a firmly attached sleeve 14 which also slides on the rod 13 and acts both as a stop for positioning the item to be processed on the working plane indicated by the number 5, as well as a support for a pressing element 16 which serves for unblocking the item 15. The chamber 11 in which the piston 12 slides is closed in its upper part by a wall or closing element 17 which acts as a guide for the sleeve 14 and presents a central portion, indicated by the number 18, which projects upward.

Above the wall 17 and around the projecting portion 18, an annular element 19 is provided so as to be mobile in an essentially vertical manner and to be kept pressed downward by a pair of springs 20 or the like.

A non-illustrated duct conveys compressed air both into the chamber 11 above the piston 12 and into the annulus between the wall 17 and the mobile annular element 19. The same compressed air therefore draws the piston 12 downward and pushes the annular element 19 upward.

A duct 25 axially passing the rod 13 exits in its upper part opposite to an opening provided in the pressing element 16 and closed by a ball valve 21.

An upper annular gasket 22 is arranged opposite the peripheral part of the pressing element 16, so as to create a suction device whenever air is aspirated from the duct 25. The unit operates as follows.

Two or more supports are first placed on the working plane in a suitable position, so as to act as stops for a first positioning of the item.

For this purpose the machine inserts a pin into the seat 9, while pushing the piston downward.

This allows the compressed air present in the chamber 8 and below the plate 4 to escape toward the outside, thus allowing the plate 4 to drop and thereby release the heads 6 of the bolts from their engagement with the walls of the grooves 3.

The support 2 can therefore freely slide and is shifted from the head up to a first starting position.

At least two fastening units are positioned and the lifting action of the relative pressing elements 16 is controlled by admitting compressed air to the lower part of the chamber 11, while opening the discharge in the upper portion.

The item is inserted up to the point of touching the sleeve 14 which acts as a stop, the pressure is then discharged from the lower part of the chamber 11 and compressed air is admitted.

This air pressure induces the annular support 19 to rise until it hits the lower surface of the item, thus compensating any irregularities in its thickness, and draws the rod 14 with the pressing element 16 downward, while acting on the piston 12.

The piece is thus firmly locked between the pressing elements 16, the supporting plane 18 and the annular element 19.

Once the item has been locked, by blocking it for instance on one side, the processing can be performed on its other sides and on the heads.

At the end of this first phase the machine picks up other fastening units by shifting them up to the point where they engage the item on the edge just having been processed, discharges the compressed air from the cylinder 11 to release the pressing element 16 and the annular support 19, unblocks the support 2 while acting on the rod 7 and removes the fastening unit, so as to enable it to also perform the processing on the remaining edge. If the processing is on the other hand to be done on elements which are essentially flat but have edges of non-uniform thickness, such as for instance the inner panels of a door which generally have sloping edges, the positioning and blocking of the items may be carried out by using suction devices.

In this case the machine draws the pressing element fully downward to contact the base 18, as shown on the right side of the FIGURE, and then actuates the aspirating devices which aspirate air across the duct 25 and inside the rod 13 to create a vacuum inside the zone bounded by the annular gasket 22, thus firmly locking the item to be processed.

This has achieved a fastening unit for blocking items to be processed on a tooling machine, which may be utilized both with flat elements such as panels or the like as well as with this elements of a complex shape, which must be fastened by a pressing element, while using a single fastening unit connected to a single pneumatic circuit capable of conveying compressed air or aspirating air from various organs, depending on the fastening system to be employed.

An expert of the trade may provide for numerous modifications and variants, all of which may however be deemed to fall within the scope of this invention.

What is claimed:

1. A fastening unit for fastening an item on a working plane of a tooling machine, comprising:

a mobile support slidable on a guide; and at least one fastening device connected to said mobile support and having, a first annular element and a second annular element concentric with and movable relative to said first annular element; and a mobile pressing element axially movable relative to said first annular element from a raised position for introducing an item, to a lowered position for fastening an item against at least one of said first and second annular elements, said second annular element having a top surface that is movable from a first position coplanar with a top surface of said first annular element, to a second position axially apart from a plane of said top surface of said first annular element.

2. The fastening unit according to claim 1, further comprising an actuating piston for pneumatically raising and lowering said mobile pressing element.

3. The fastening unit according to claim 2, further comprising a device for conveying compressed air to a chamber of said actuating piston for moving said mobile pressing element to said lowered position and for simultaneously conveying compressed air to said second annular element for moving said second annular element to said second position.

4. The fastening unit according to claim 1, further comprising a biasing element to bias said second annular element in said first position.

5. The fastening unit according to claim 1, wherein said mobile support comprises a pneumatic gripping device.

6. The fastening unit according to claim 5, wherein said pneumatic gripping device comprises:

a mobile plate;

at least one gripping element connected to said mobile plate and releasably engageable with a wall of said guide; and a means for conveying a pressurized fluid between said mobile plate and said mobile support, to engage said at least one gripping element with said wall and to immobilize said mobile support.

7. The fastening unit according to claim 6, further comprising a piston movable from a first position to a second position within a chamber defined between said mobile plate and said mobile support, wherein when said piston is in said first position said chamber is pressurized and said mobile support is immobilized and when said piston is in said second position said chamber is depressurized and said mobile support is movable.

8. The fastening unit according to claim 1, further comprising at least two of said at least one fastening devices.

9. A unit for fastening an item on a working plane of a tooling machine, comprising:

a support surface;

a pressing element that is axially movable relative to said support surface between a raised position for introducing an item to be held by the pressing element and a lowered position for pressing an item against said support surface;

said support surface having first gripping means for engaging an item pressed against said support surface by said pressing element, said pressing element moving a first distance relative to said first gripping means, and second gripping means moving a second distance, different from said first distance, relative to said pressing element to engage an item pressed against said support surface by said pressing element.

10. The fastening unit according to claim 9, wherein said first and second gripping means are annular.

11. The fastening unit according to claim 10, wherein said first and second gripping means are concentric.

12. The fastening unit according to claim 11, further comprising an actuating piston for pneumatically raising and lowering said pressing element, a rod of said actuating piston being concentric with said first and second gripping means.

13. The fastening unit according to claim 12, further comprising a biasing element for biasing said second gripping means in a first position.

14. The fastening unit according to claim 13, further comprising a device for conveying compressed air to a chamber of said actuating piston for moving said pressing element to said lowered position and for simultaneously conveying compressed air to said second annular element for moving said second annular element to a second position against a force from said biasing element.

* * * * *